US012455126B2

(12) United States Patent
Merklin

(10) Patent No.: US 12,455,126 B2
(45) Date of Patent: Oct. 28, 2025

(54) MODULAR FRAME AND CHASSIS SYSTEM FOR A FIREARM

(71) Applicant: ICARUS PRECISION LLC, Washougal, WA (US)

(72) Inventor: Travis Merklin, Washougal, WA (US)

(73) Assignee: ICARUS PRECISION LLC, Washougal, WA (US)

( * ) Notice: Subject to any disclaimer, the term of this patent is extended or adjusted under 35 U.S.C. 154(b) by 0 days.

(21) Appl. No.: 18/889,147

(22) Filed: Sep. 18, 2024

(65) Prior Publication Data

US 2025/0189247 A1 Jun. 12, 2025

Related U.S. Application Data

(60) Provisional application No. 63/608,783, filed on Dec. 11, 2023.

(51) Int. Cl.
*F41A 3/66* (2006.01)
*F41A 11/02* (2006.01)

(52) U.S. Cl.
CPC ..... *F41A 3/66* (2013.01); *F41A 11/02* (2013.01)

(58) Field of Classification Search
CPC ..... F41A 3/66; F41A 11/02; F41A 3/64
USPC ..... 89/195–196
See application file for complete search history.

(56) References Cited

U.S. PATENT DOCUMENTS

| | | | | |
|---|---|---|---|---|
| 6,260,301 | B1 | 7/2001 | Aigner et al. | |
| 8,429,844 | B2 | 4/2013 | Dextraze et al. | |
| 8,522,465 | B2 | 9/2013 | Jarboe et al. | |
| 9,239,203 | B2 | 1/2016 | Jarboe et al. | |
| 10,119,777 | B2 | 11/2018 | Wolf et al. | |
| 10,955,209 | B2 | 3/2021 | Wolf et al. | |
| 11,187,492 | B2 * | 11/2021 | Mumford | F41C 23/10 |
| 11,525,645 | B2 | 12/2022 | Wolf et al. | |
| 12,146,718 | B2 * | 11/2024 | Uzun | F41A 3/66 |
| 2019/0024996 | A1 | 1/2019 | Borges et al. | |
| 2023/0104146 | A1 | 4/2023 | Wolf et al. | |

* cited by examiner

*Primary Examiner* — Reginald S Tillman, Jr.
(74) *Attorney, Agent, or Firm* — Miller Nash LLP

(57) ABSTRACT

A modular firearm system has a frame with a grip configured to be held by a hand of a user and a receiving chamber formed within the grip. The system further has a chassis having a receiving channel and one or more sidewalls extending from a bottom portion of the chassis, the one or more sidewalls structured to fit within and be received by the receiving chamber of the frame. The system further has a barrel locking block structured to fit within the receiving channel of the chassis.

20 Claims, 21 Drawing Sheets

MODULAR FRAME AND CHASSIS SYSTEM FOR A FIREARM

CROSS-REFERENCES TO RELATED APPLICATIONS

This patent application claims the benefit of provisional Application No. 63/608,783, filed Dec. 11, 2023, which is incorporated into the present disclosure by this reference.

FIELD OF THE INVENTION

This disclosure is directed to a modular handgun system featuring a modular frame and chassis adaptable for use with multiple generations and sizes of slides, and a method of assembling the same.

BACKGROUND

Modular handgun systems originated from a competition of the same name run by the U.S. Army and U.S. Airforce to find a new service pistol. First announced in 2011, the competition sought out a replacement sidearm with numerous requirements, including modularity. While the Sig Sauer® P320 ultimately won, other modular entrants went on to enter the handgun market, including modular systems by GLOCK®.

Modular handgun systems have been successful both inside and outside the military context because of the benefits of a modular handgun. Traditional, non-modular handguns were limited to particular uses and applications based on the configuration of the weapon. As a result, a shooter needed to have access to multiple, complete handguns for multiple applications, an expensive and burdensome endeavor.

However, by employing a modular handgun system, a person can quickly and safely alter a handgun to make it better suited or more effective for the particular application at hand. The handgun could be modified for the needs of the shooter, such as changing the gun to suit a particular user's specific requirements. For instance, a shooter with smaller hands may need a frame with a smaller grip than a shooter with larger hands. Alternatively or additionally, the handgun can be modified for the particular mission, such as adding particular accessories needed for a night mission. Modular handgun systems have also become popular for their ease of use and maintenance, as repairing or replacing parts on a modular handgun is much simpler than doing so on a traditional, non-modular weapon, a great benefit in combat settings particularly. And, of course, modular handgun systems have grown in popularity for the customizability they provide, for instance, the ability to swap out a frame with a traditional black grip for a frame with a more unique grip, making the handgun more aesthetically pleasing to a particular shooter.

Existing modular handgun systems provide a certain level of flexibility. For instance, GLOCK® modular systems consist of two main modules: the slide-and-barrel portion of the firearm, otherwise known as an "upper," and the frame portion otherwise known as a "lower," which includes a chassis, trigger assembly, and grip. In some cases, the chassis, formed of metal, is embedded in the polymer frame during injection molding, such that the chassis is integral with the polymer frame. In others, the chassis is removable from the frame. In either instance, the length of the upper (slide and barrel) may differ between styles of weapon. For instance, a subcompact slide and barrel is shorter than a standard slide and barrel, while a long slide is longer than the standard slide and barrel. Because the entire length of the GLOCK® upper is received by the polymer frame, the length of which extends laterally away from the grip portion of the frame, a standard slide is not compatible with a subcompact frame, such that multiple frames are needed in addition to multiple slides. In other cases, a user may have two uppers with standard barrels, one 9 mm and one .40 caliber, and two frames of appropriate length, one for a 9 mm and one for a .40 caliber. While the 9 mm slide can be swapped onto the .40 caliber frame, and vice versa, because of differences in the ejectors in the respective trigger assemblies, issues can arise. For instance, a 9 mm GLOCK® frame includes a bent ejector (because a 9 mm bullet is smaller) while a .40 caliber GLOCK® frame includes a straight ejector (because a .40 caliber bullet is bigger). So, while the .40 caliber upper can conceivably be used on the 9 mm lower, the bent ejector of the 9 mm lower could interfere with the primer on the .40 caliber bullet, causing a misfire. While the ejector itself can be changed out, or the entire trigger assembly can be changed out, this additional effort makes the GLOCK® system less flexible and somewhat cumbersome. Still other issues arise as between different generations of GLOCK® components; for instance, a Gen 3 frame is different than a Gen 4 frame, so the uppers are not interchangeable as between a Gen 3 and Gen 4 weapon.

Another issue with the GLOCK® system is that the entire lower—including the chassis and grip—is the "serialized" portion of the weapon in the United States, meaning that it is subject to ATF, state, and/or local rules and regulations, slowing down and complicating the buying process. The upper, in contrast, is not "serialized," and so can be readily sold as an accessory. Thus, while it may be desirable for a user to own multiple frames, both for aesthetics and for different uses, it is practically more difficult to do so since the frame is serialized.

The ZEV Technologies OZ9® modular system, described in U.S. Pat. No. 10,119,777, attempts to overcome some of these issues by employing a single, modular chassis separate from the frame, compatible with different frame sizes and slide lengths. The modular chassis is configured to extend beyond the length of the frame, such that when a slide is installed on the weapon, it is in contact with the chassis but not with the frame. The portion of the chassis that extends beyond the length of the frame includes an accessory rail, such as a picatinny rail. A proprietary barrel locking block is formed integral to the modular chassis. The modular chassis is further configured to be of a length that is compatible with multiple slide lengths, such as standard, compact, and subcompact slides, such that only one chassis is needed for different slide lengths. The chassis itself, rather than the entire lower, is the "serialized" part, so a user can readily obtain new frames (and hence new grips) without having to go through the rules and regulations the chassis must go through because the frame is not serialized.

As with the GLOCK® system, however, the OZ9® system has limitations. Because the accessory rail is included on the chassis rather than on the frame, a user is limited to having an accessory rail on his weapon whether he needs one or not, and is limited to the particular type of accessory rail that is included with the chassis. The placement of the accessory rail may not be ideal for certain applications, or the rail type itself may not be suitable, but the user is limited to the rail type built into the OZ9® chassis. Further, because the chassis is of a length that can accept multiple slide lengths, when a slide shorter than the full length of the chassis is used, the chassis extends beyond the length of the slide, which may make the assembled weapon less aesthetically pleasing and/or more difficult to holster or remove from the holster. The diameter of the OZ9® chassis' channel, which receives the portion of the upper including the recoil spring, is also static as a result of inclusion of an integrated accessory rail. Because Gen 3 GLOCK® and clone slides have a smaller diameter for the recoil spring in the upper than do Gen 4/5 GLOCK® and clone slides, an OZ9® chassis sized to fit a Gen 3 GLOCK® upper will not fit a Gen 4/5 GLOCK® upper, and vice versa, because of the different chassis channel diameter.

Thus, while in theory the OZ9® overcomes the serialization shortcomings of the GLOCK® system, allowing for greater flexibility in the frame, practically speaking multiple chasses may still be needed, meaning multiple serialized components are needed. And because the OZ9®, like others on the market, features an integrated, proprietary locking block, and an accessory rail with a fixed the chassis channel diameter, is limited to use with only with particular GLOCK® models-a Gen 3 compatible chassis will not work with a Gen 4/5 upper, for example, because of differences in the locking block and the different chassis channel diameters in the integral accessory rail.

Thus, while both the GLOCK® and OZ9® modular handgun systems provide more flexibility than a traditional, non-modular firearm, they are still limited. Embodiments of the invention address these and other limitations.

DETAILED DESCRIPTION OF THE EMBODIMENTS

Figure 1:
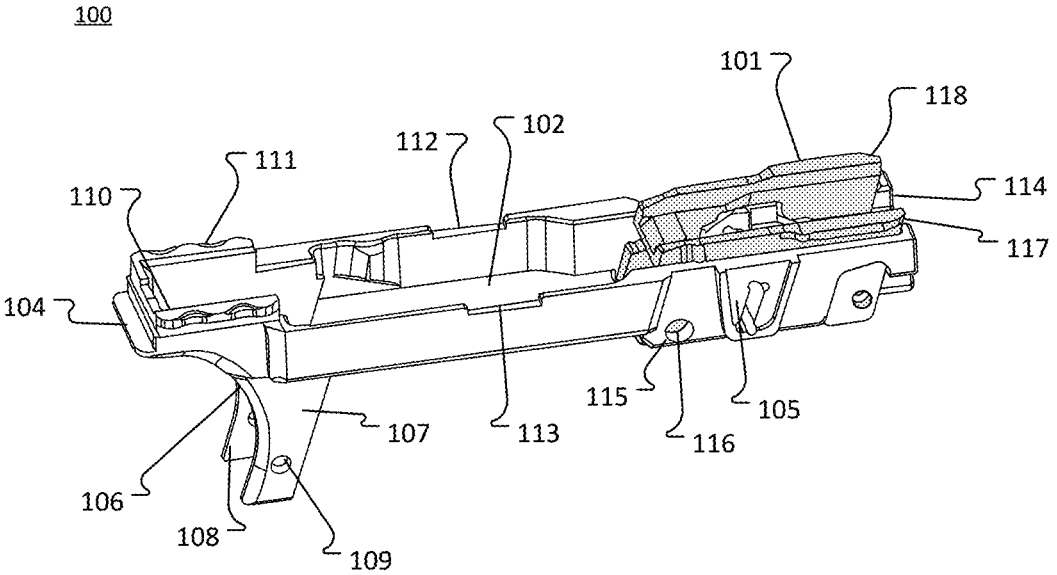
FIGS. 1-6 are different perspective views of a modular chassis according to embodiments of the invention.
Figure 2:
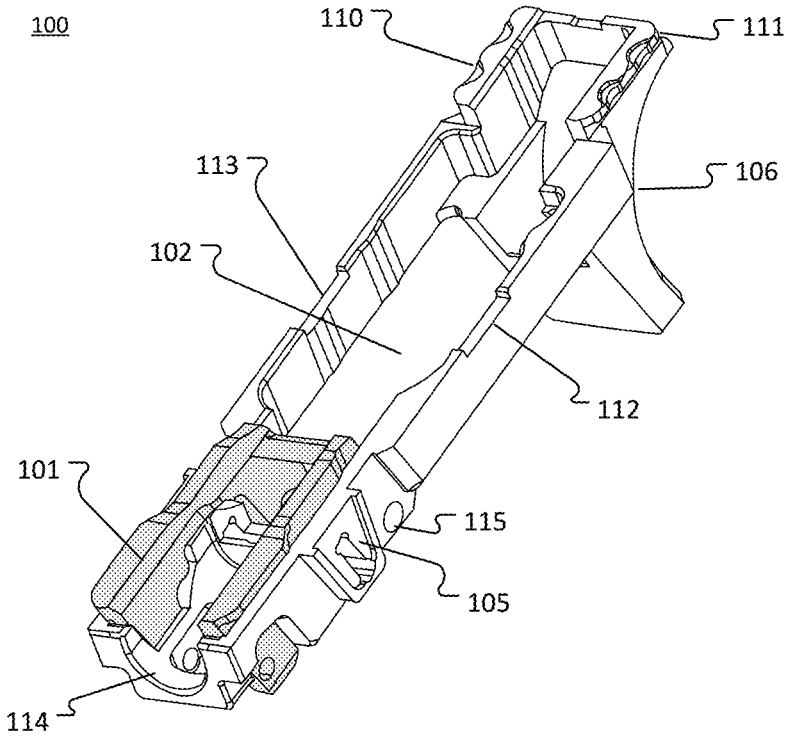

The embodiments described herein provide a modular frame and chassis for a modular handgun system, adaptable for use with multiple generations and sizes of slides, and a method of assembling the same.

FIGS. 1-6 show a modular chassis 100 according to an embodiment of the invention. FIGS. 7-15 show a modular frame 200 with optional accessory rail extension module 207 according to an embodiment of the invention. FIGS. 16-19 show an assembly of a modular chassis 100 and modular frame 200 according to an embodiment of the invention. The interoperation between these modular components will become evident through the disclosures herein.

Turning to FIGS. 1-6, a modular chassis 100 according to an embodiment is shown. The modular chassis 100 is adapted to receive a barrel locking block 101. In an embodiment, barrel locking block 101 is a separate component from the chassis 100, which can be added to the chassis 100 by a user. The barrel locking block 101 helps to avoid accidental discharge by ensuring the barrel and slide of the upper are securely locked together during the firing process. Different generations of GLOCK® uppers are compatible with different barrel locking blocks. By using a separate barrel locking block 101 instead of an integrally formed barrel locking block—for instance, cast as part of the chassis 100—chassis 100 is adaptable for use with multiple generations of GLOCK® (or GLOCK® clone) uppers simply by changing the barrel locking block 101, rather than being limited to use with an upper compatible with the integral locking block. In another embodiment, the barrel locking block 101 may instead be integral with the chassis 100, for example, cast as part of the chassis 100. In such an embodiment with an integral locking block, the chassis 100 may only be compatible with certain generations of GLOCK® uppers.

In an embodiment, chassis 100 further includes a hollow portion 102 positioned rearward of the portion in which the barrel locking block 101 is received. Hollow portion 102 is configured to receive a trigger assembly (not shown in FIGS. 1-6). When chassis 100 is received in the modular frame 200, as discussed further below, hollow portion 102 corresponds to a hollow portion 201 of the modular frame 200 (see FIG. 7), such that a trigger assembly (not shown in FIGS. 1-6) can be received by the modular-chassis-and-frame combination. The trigger assembly may be, for instance, an assembly suitable for use with 9 mm rounds, or an assembly suitable for use with .40 caliber rounds, or an assembly suitable for use with any other caliber of rounds. In this manner, the modular-chassis-and-frame assembly can be used with any caliber of round, so long as an appropriate trigger assembly is employed.

In an embodiment, chassis 100 further includes a rear extension 104 extending substantially rearward from the chassis 100. Rear extension 104 is adapted to be substantially received by recess 202 of the modular frame 200 (see FIGS. 7, 18, 19). In this manner, chassis 100 is assembled with frame 200 by sliding rear extension 104 into recess 202 of the frame 200, thereby placing the chassis 100 in proper alignment with the frame 200 so that chassis 100 can be received by and assembled with frame 200 via a downward rotation of chassis 100 along the length of frame 200.

In an embodiment, chassis 100 further includes a rear arch portion 106 formed of a pair of substantially parallel sidewalls 107, 108 extending substantially downward from the longitudinal axis of the chassis 100. In an embodiment, each of sidewalls 107, 108 further includes one or more through holes 109. Each of the through holes 109 is substantially parallel to the other—that is, one of through holes 109 corresponding to sidewall 107 is substantially parallel to one of through holes 109 corresponding to sidewall 108. Through holes 109 may be utilized to hold the trigger assembly (not shown) in the chassis. The rear arch portion 106 corresponds to a convex portion 204 of the frame 200 (see FIG. 7) such that when the chassis 100 is downwardly rotated along the length of the frame 200, the convex portion 204 of the frame fits substantially with the rear arch portion 106 of the chassis, aiding in placing chassis 100 in proper alignment with frame 200.

Figure 7:
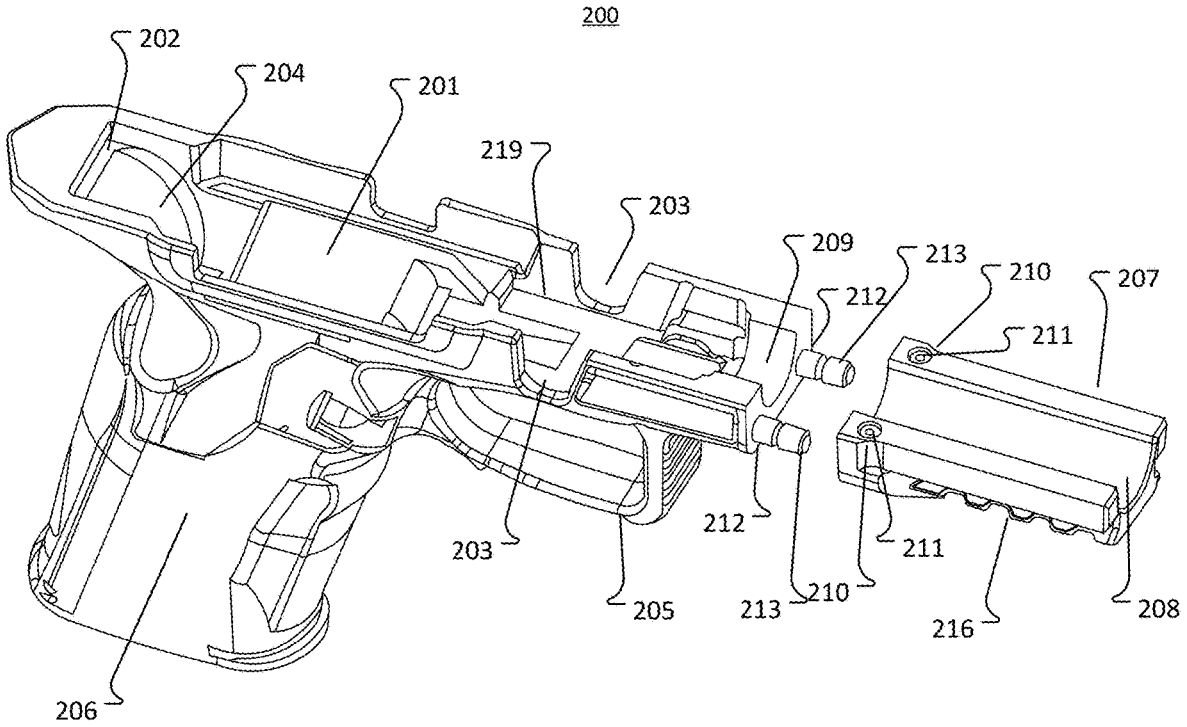
FIGS. 7-13 are different perspective views of a modular frame and modular accessory rail according to embodiments of the invention.
Figure 16:
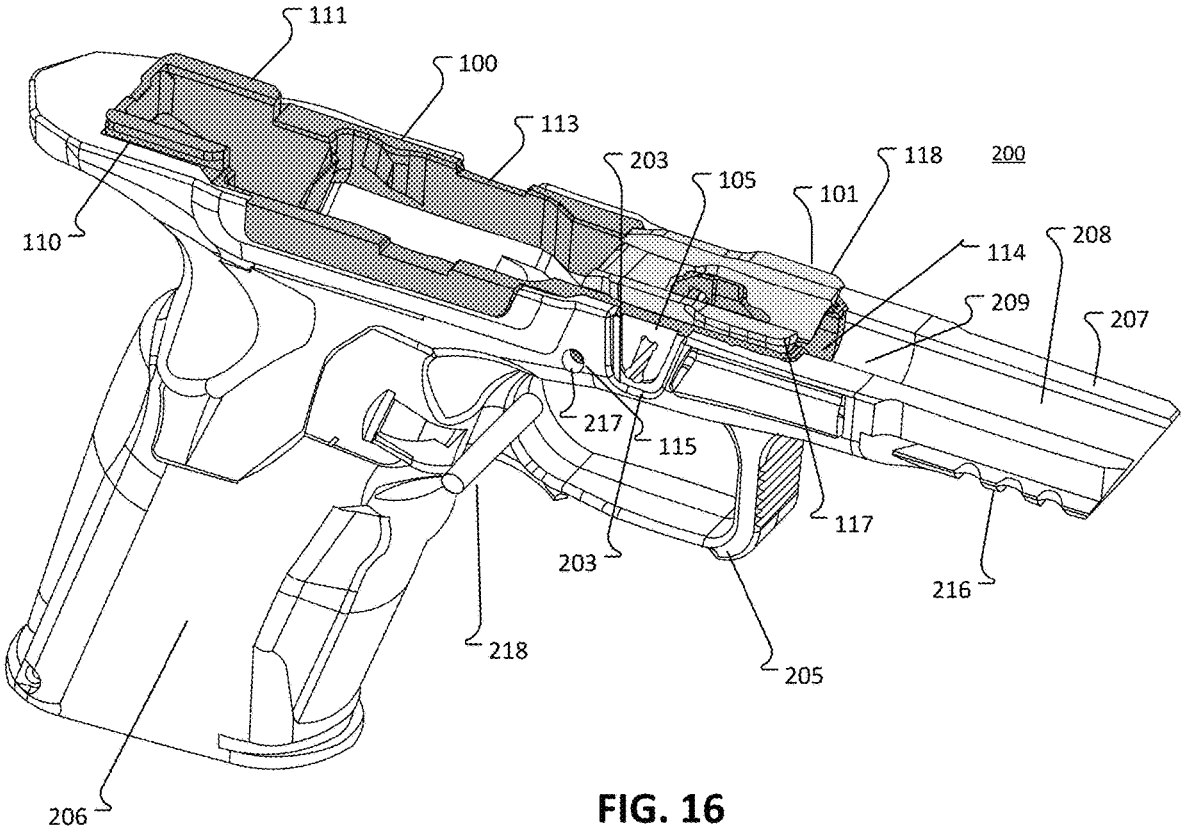
FIGS. 16-17 are different perspective views of a modular chassis assembled with a modular frame and modular accessory rail according to embodiments of the invention.
Figure 17:
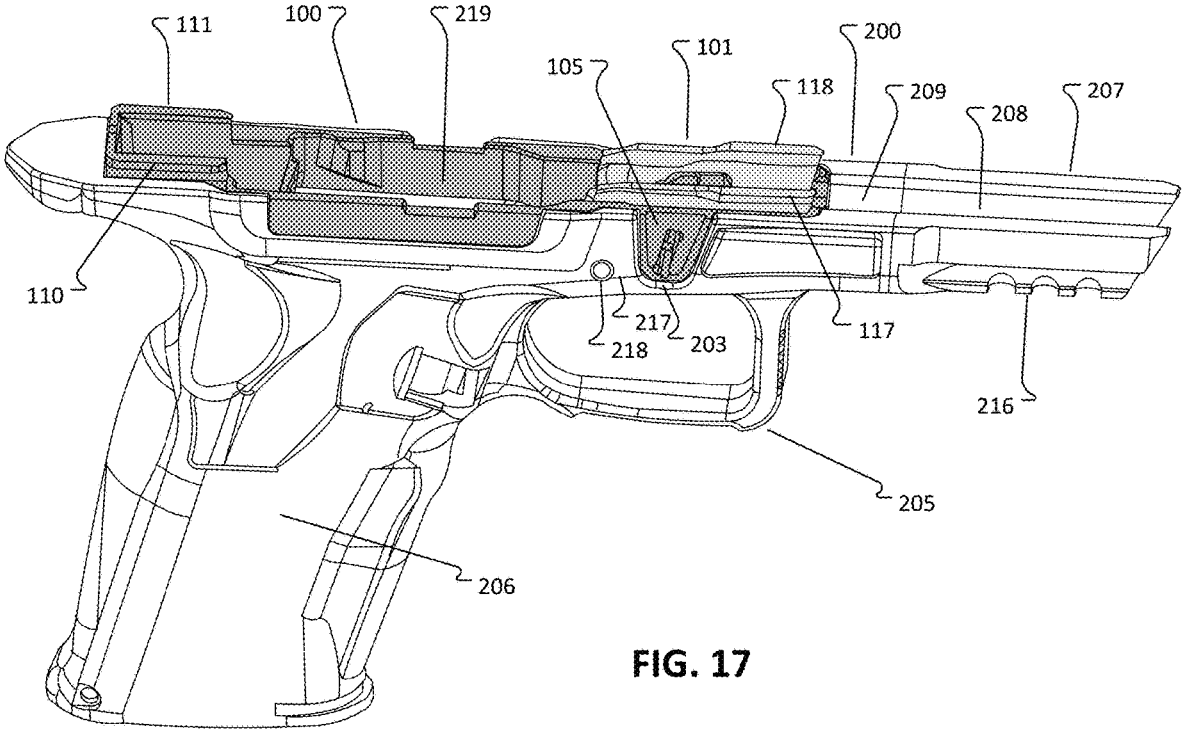
Figure 18:
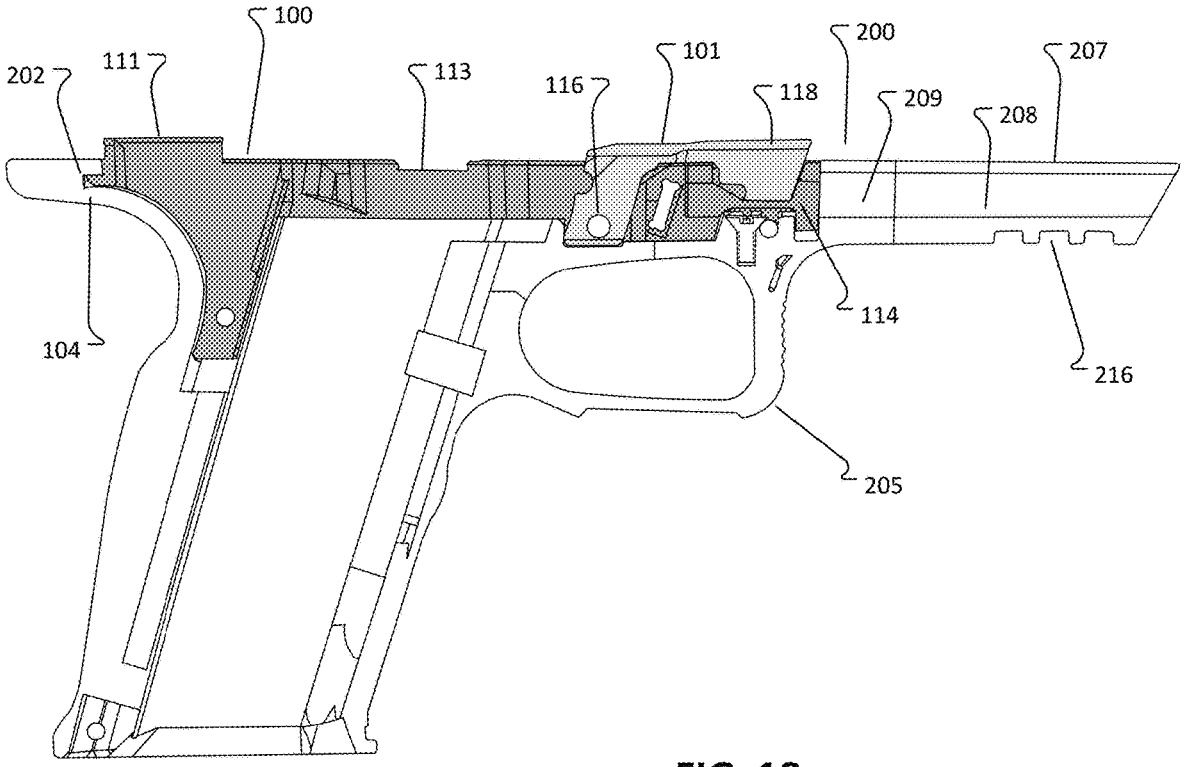
FIGS. 18-19 are different section views of a modular chassis assembled with a modular frame and modular accessory rail according to embodiments of the invention.
Figure 19:
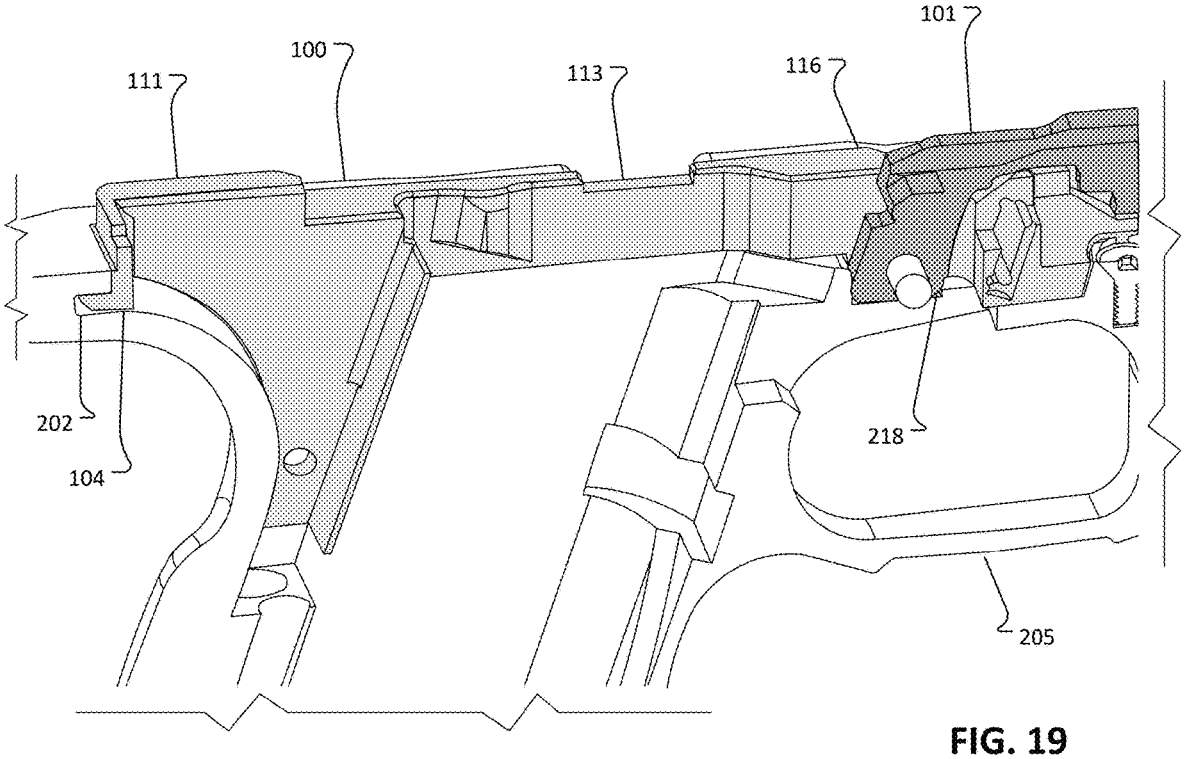

In an embodiment, chassis 100 further includes at least one alignment projection 105 formed on the outer side of the chassis 100 toward its distal end, said alignment projection 105 adapted to be substantially received by a corresponding alignment notch 203 formed in the side of the frame 200 (see FIGS. 7, 16, 17). In an embodiment, the chassis 100 includes two alignment projections 105, one formed on each side of the chassis 100, each alignment projection 105 adapted to be substantially received by one of two alignment notches 203 formed on each side of the frame 200. In that embodiment, each alignment projection 105 is adapted to be substantially received by a corresponding alignment notch 203 of the frame 200. Alignment projections 105 and alignment notches 203 aid in placing chassis 100 in proper alignment with frame 200 when chassis 100 is assembled with frame 200 via downward rotation of chassis 100 along the length of frame 200.

Figure 8:
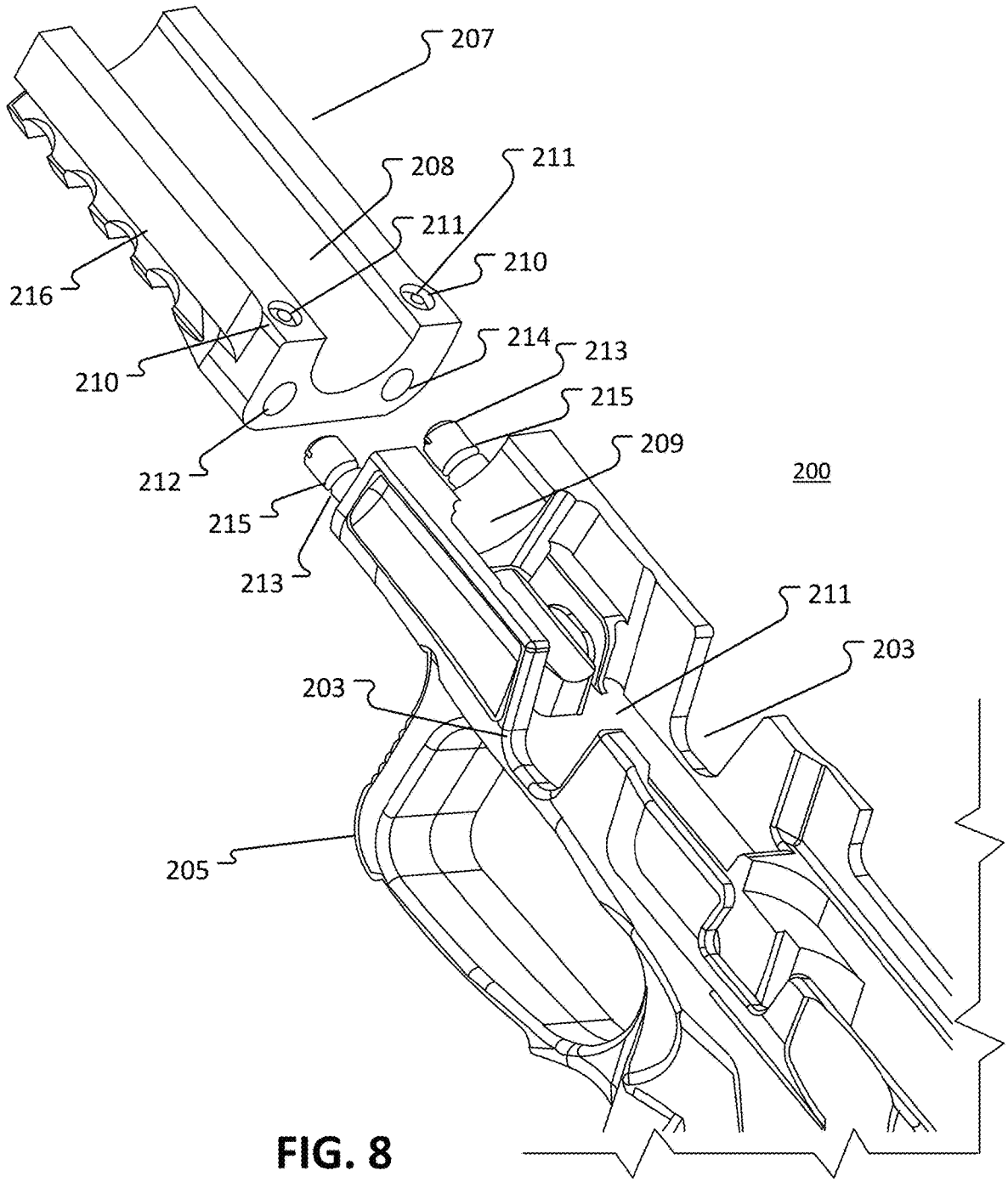
Figure 9:
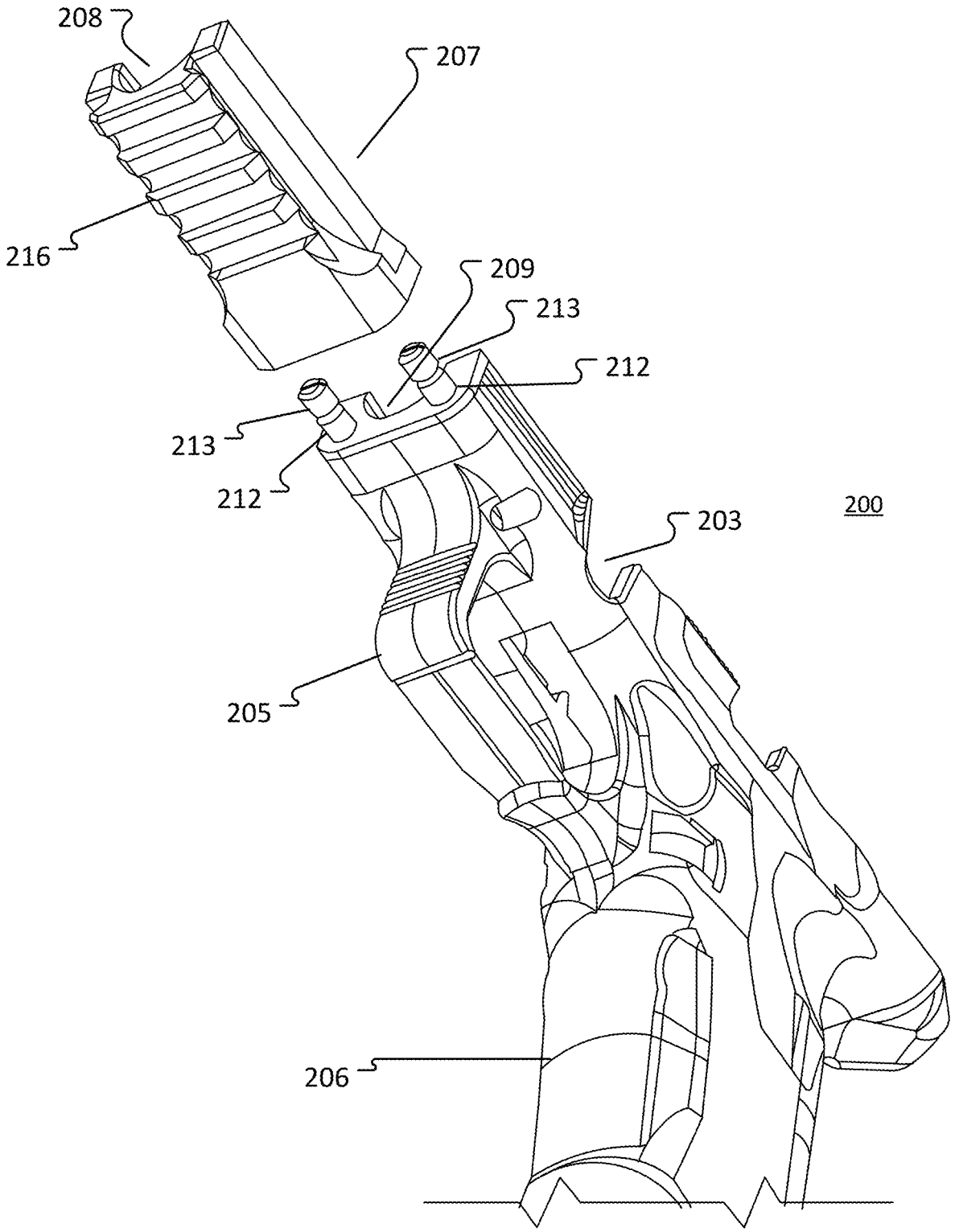
Figure 10:
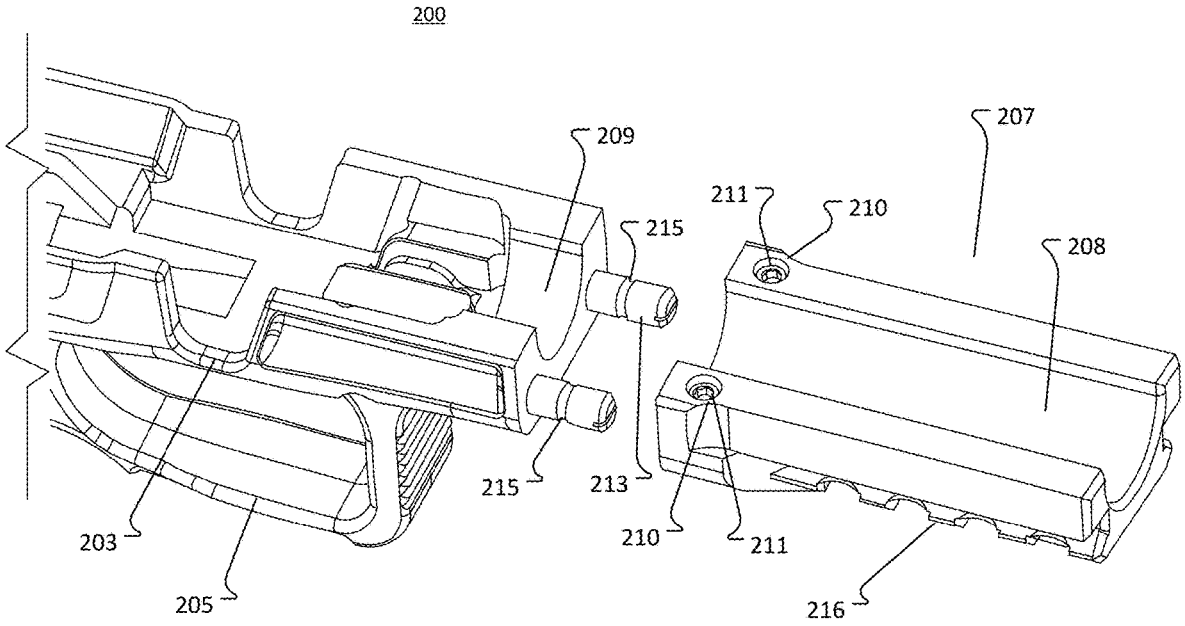
Figure 11:
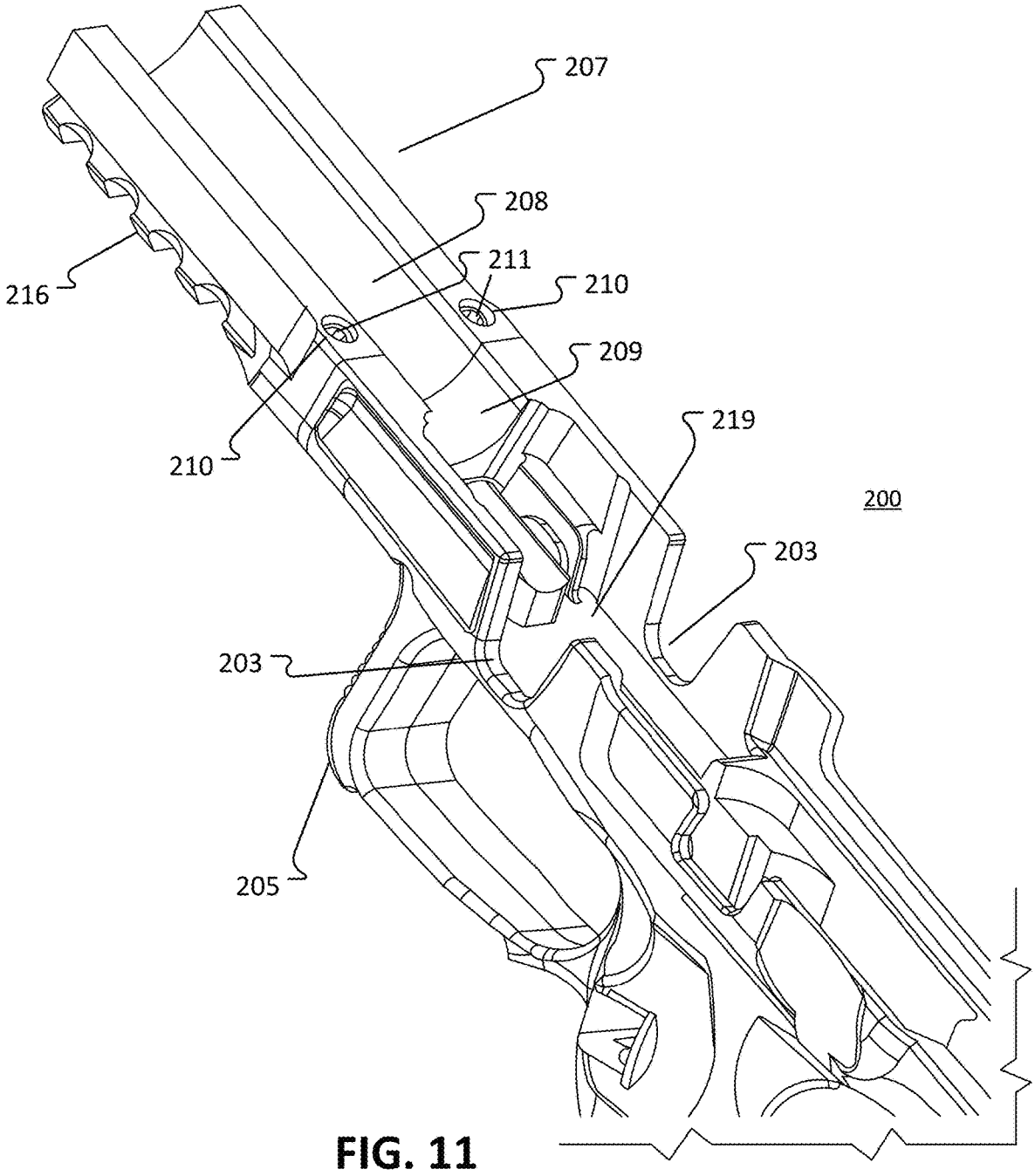
Figure 12:
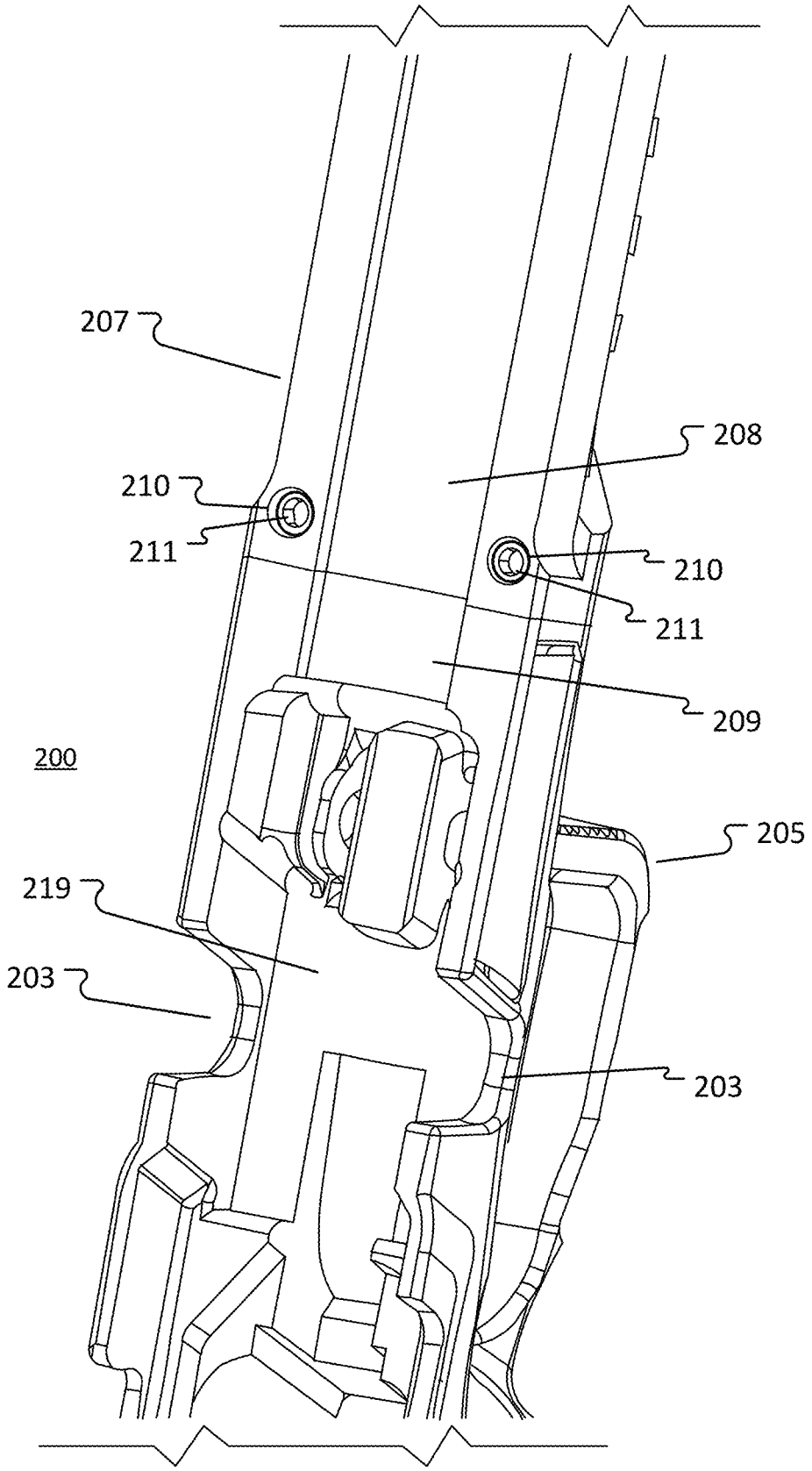
Figure 13:
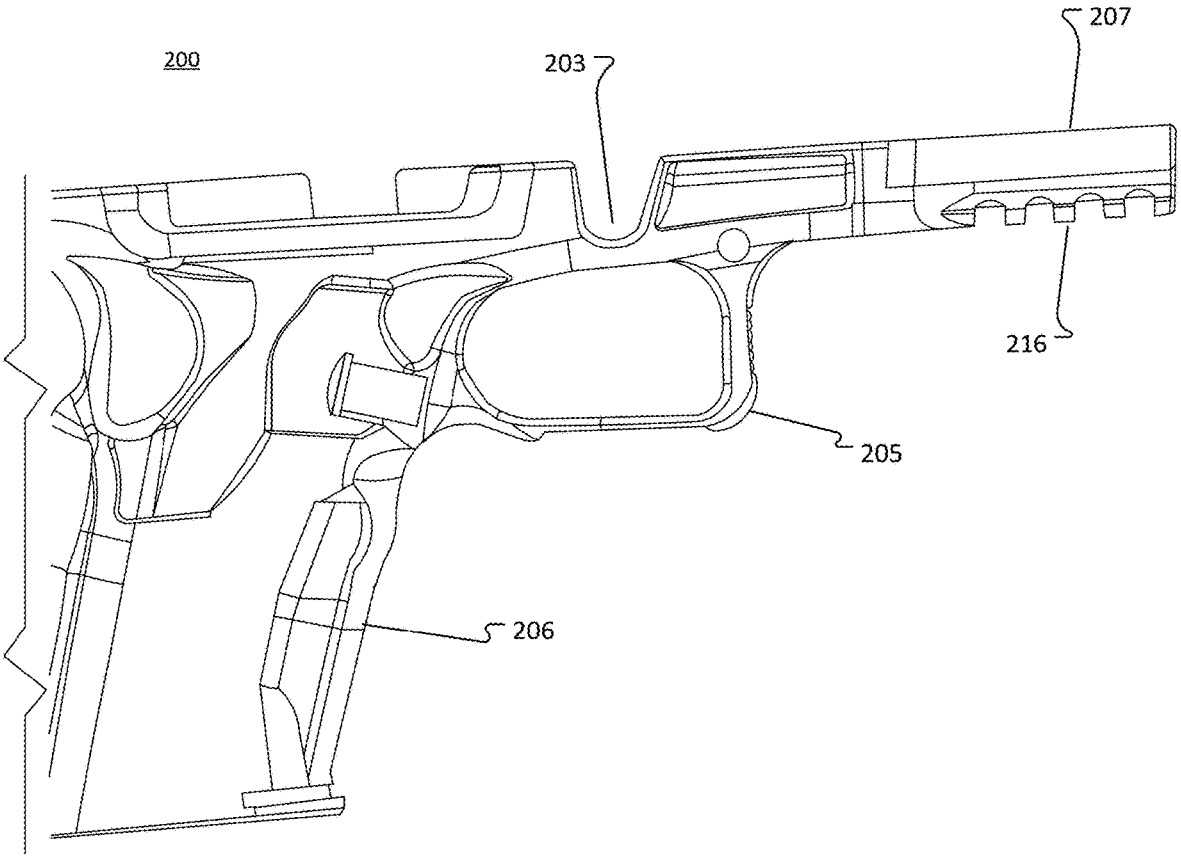
Figure 14:
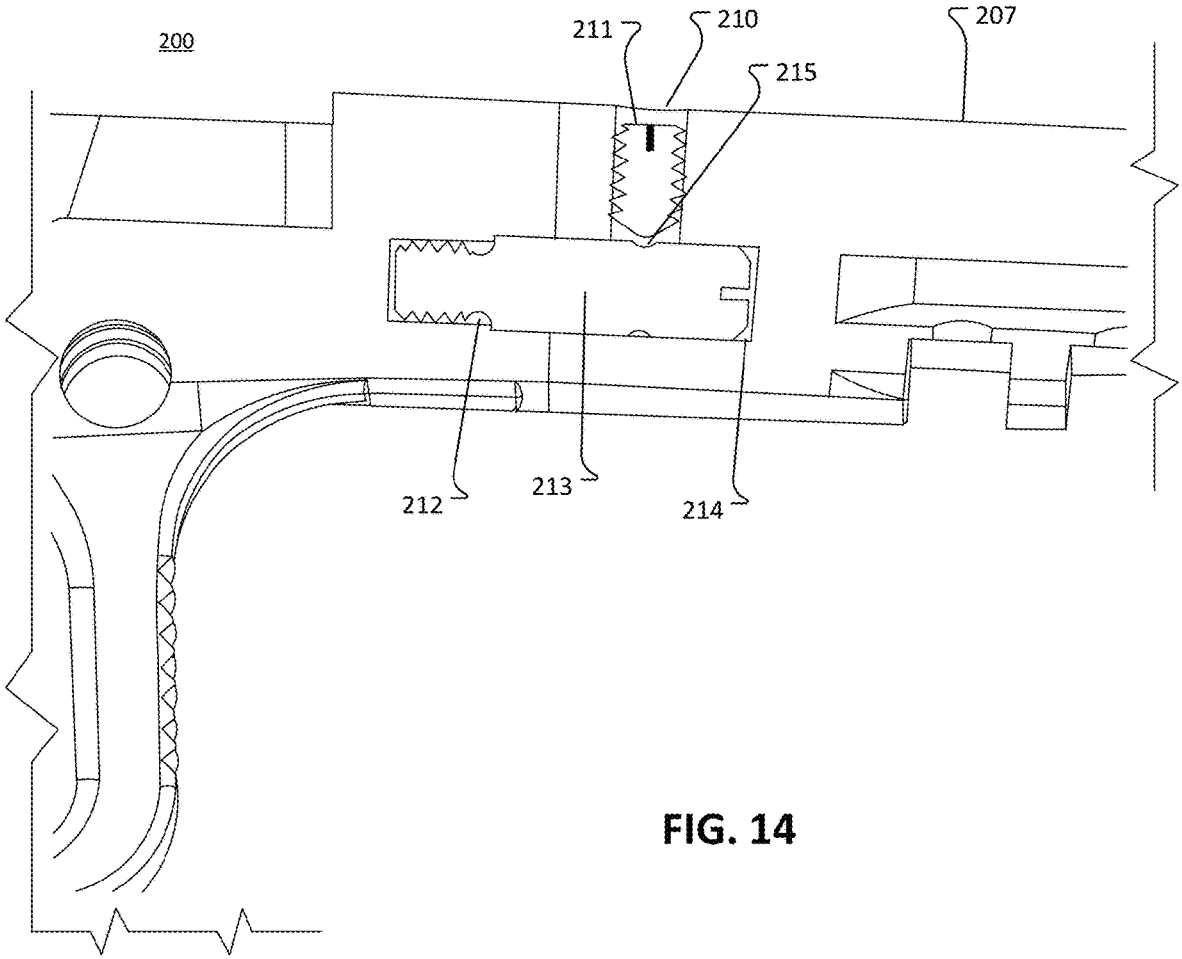
FIGS. 14-15 are different section views of a modular frame and modular accessory rail according to embodiments of the invention.
Figure 15:
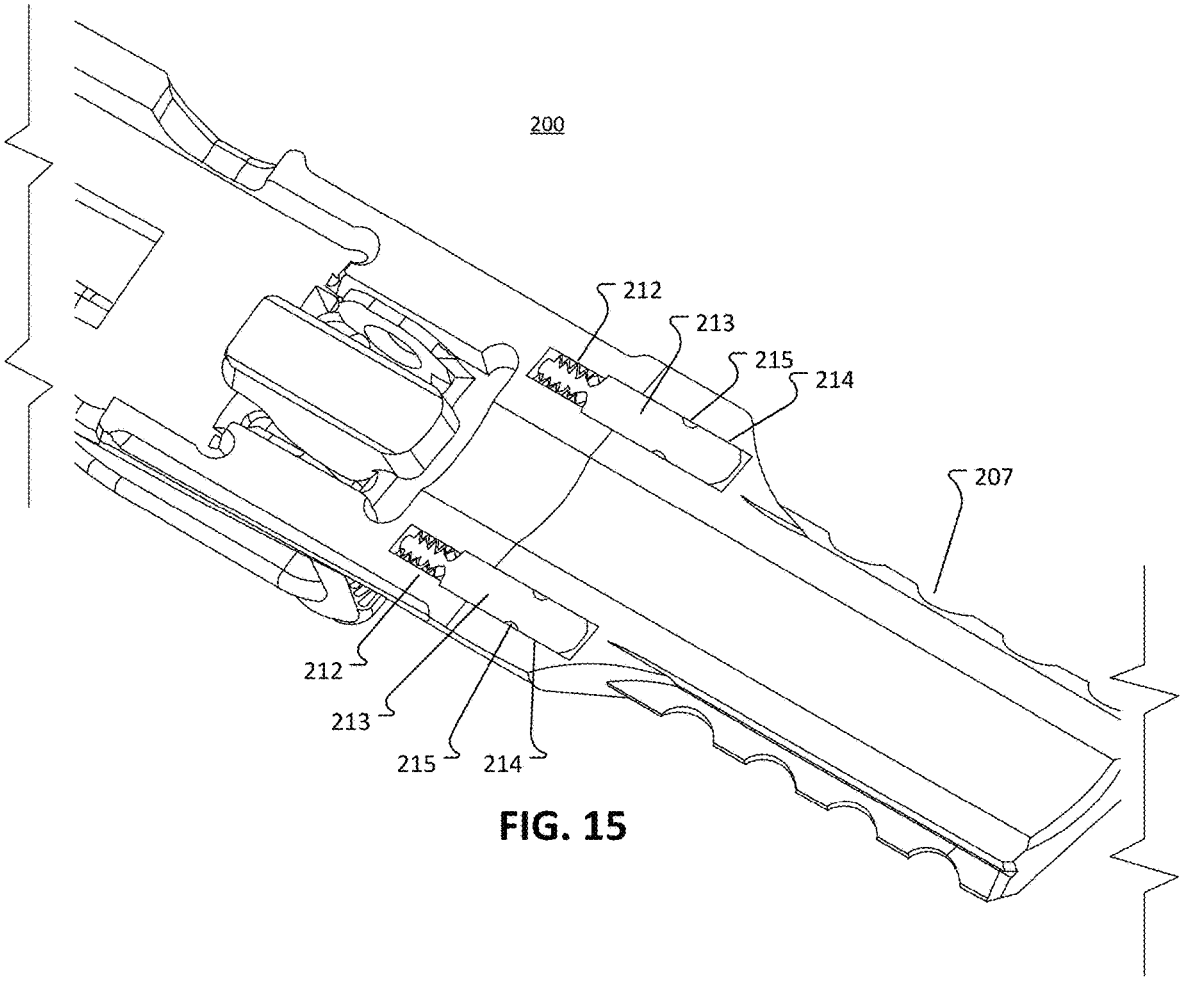

In an embodiment, frame 200 includes a receiving chamber 219 within which chassis 100 is partially received when chassis 100 is assembled with frame 200 (see, e.g., FIGS. 8, 17). Receiving chamber 219 is partially recessed from channel 209 of the frame, such that when chassis 100 is assembled with frame 200, a substantially continuous channel is formed between channel 209 of the frame 200 and channel 114 of the chassis, as discussed further below. The receiving chamber 219 is also at least partially formed within the grip portion 206, such that sidewalls 107, 108 fit within the grip portion 206 when chassis 100 is assembled with frame 200.

In an embodiment, each of the rear extension 104 of the chassis 100 and recess 202 of the frame 200, the rear arch portion 106 of the chassis 100 and convex portion 204 of the frame 200, and the one or more alignment portions 105 of the chassis and one or more alignment notches 203 of the frame aid in aligning and assembling the modular chassis 100 with the modular frame 200 without the need for any tools. In another embodiment, the system may only utilize one or two of these alignment methods. For example, the system may only utilize the one or more alignment portions 105 and alignment notches 203, without also utilizing the other alignment methods discussed herein; or may only utilize the rear extension 104 and recess 202, without also utilizing the other alignment methods discuss herein; or may only utilize the rear arch portion 106 and convex portion 204, without also utilizing the other alignment methods discussed herein.

Figure 3:
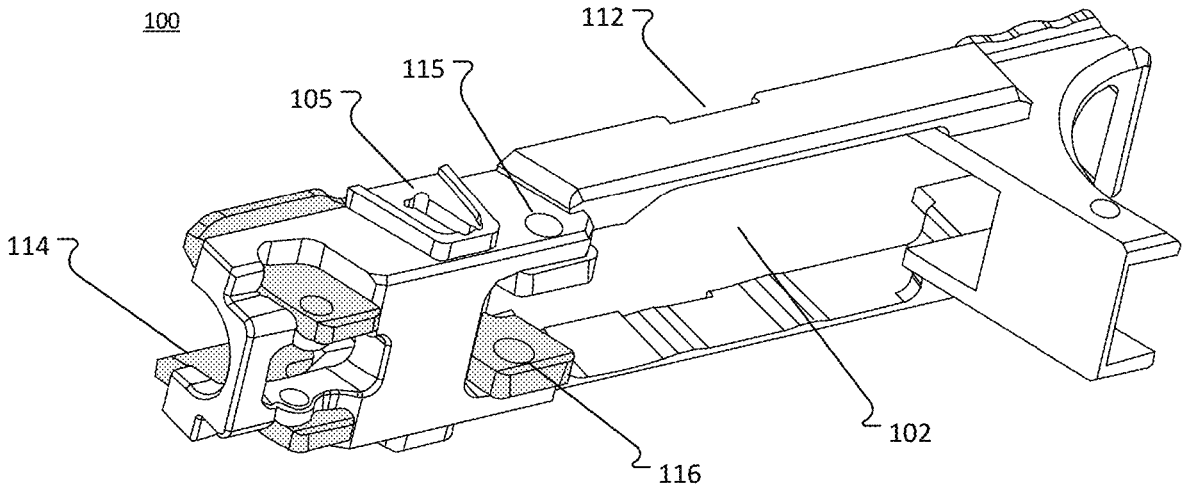
Figure 4:
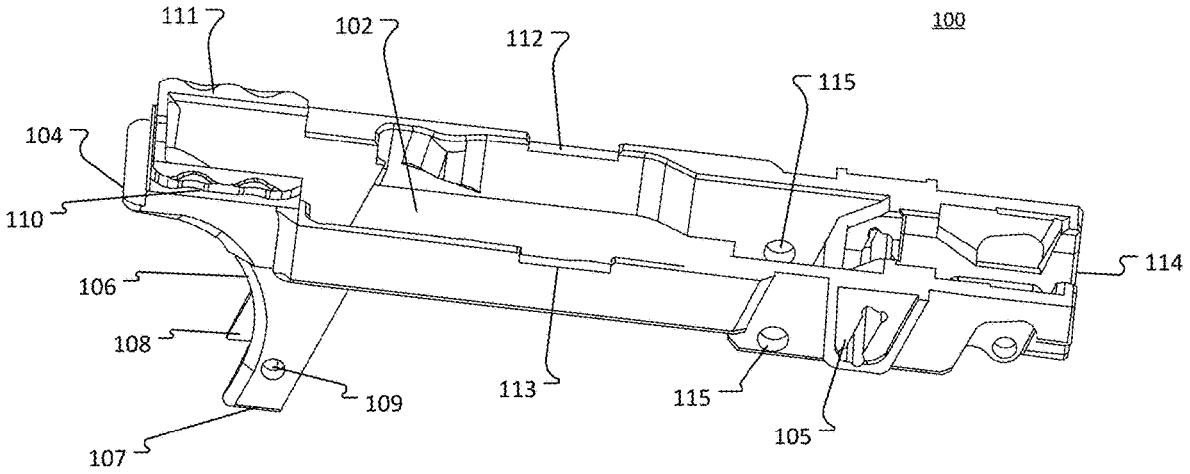
Figure 5:
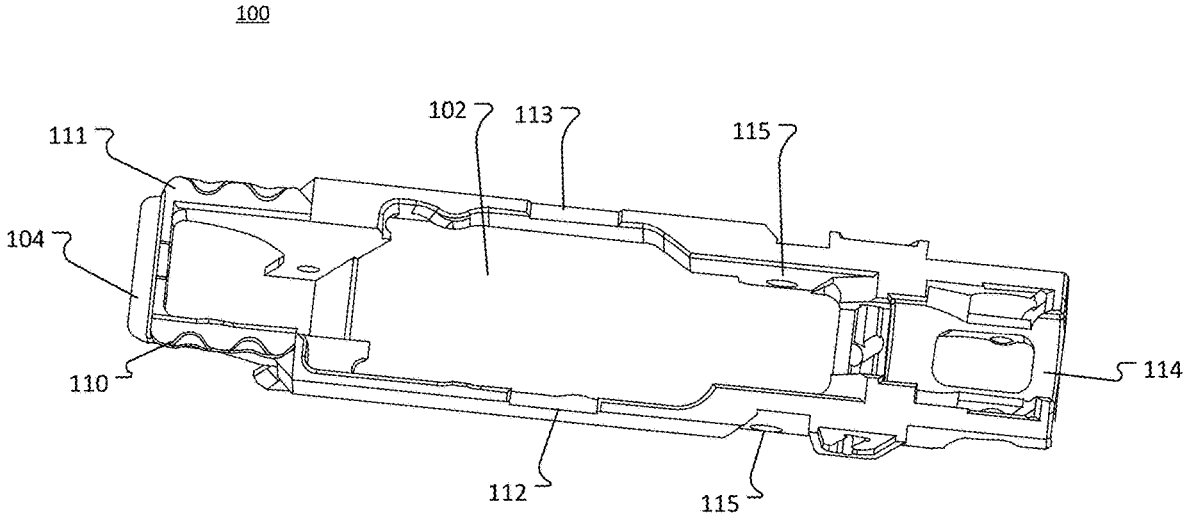
Figure 6:
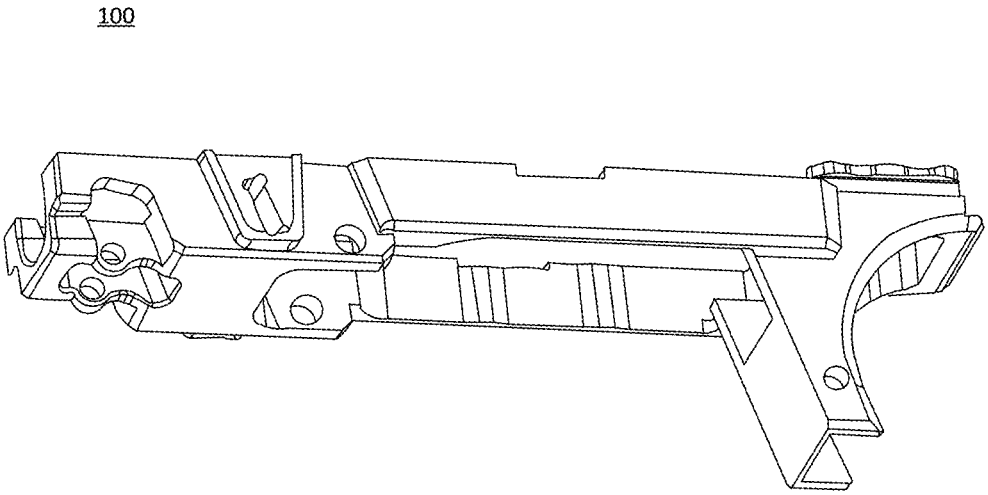

In an embodiment, chassis 100 further includes one or more through holes 115 adapted to substantially align with one or more through holes 116 formed on the barrel locking block 101 (see, e.g., FIGS. 1, 3, 4). As shown in FIGS. 16-19, frame 200 further includes one or more through holes 217 adapted to substantially align with the one or more through holes 115 on the chassis 100. Through holes 115, 116, and 217 are each sized to receive a pin 218. Pin 218 is sized to substantially span the distance from one side of the frame 200 to the other side of the frame 200. In this manner, when chassis 100 is assembled with frame 200, the pin 218 is passed through the aligned through holes 217, 115, and 116 from one side of the frame 200 to the other side, thereby holding frame 200, chassis 100, and barrel locking block 101 together in the assembled handgun. In embodiments with an integral barrel locking block 101, through holes 217, 115, and 116 on the frame 200 and chassis 100, respectively, substantially align to receive pin 218, pin 218 substantially spanning the distance from one side of frame 200 to the other side of frame 200, pin 218 passing through aligned through holes 217 and 115 to hold frame 200 and chassis 100 together in the assembled handgun.

In an embodiment, the through holes 217 on the frame 200 are formed on each side of the frame above the trigger guard 205 and rearward of the alignment notches 203, with the through holes 115 and 116 of the chassis 100 and barrel locking block 101 formed in corresponding locations to permit proper alignment of the through holes 217 and 115 when the chassis 100 with barrel locking block 101 is received within frame 200 as described elsewhere. In another embodiment, through holes 217 on the frame 200 may be formed elsewhere on the frame 200, with the through holes 115 and 116 of the chassis 100 and barrel locking block 101 formed in corresponding locations to permit proper alignment of the through holes 217, 115, and 116 when the chassis 100 with barrel locking block 101 is received within the frame 200 as described elsewhere.

In an embodiment, chassis 100 further includes a pair of rear slide rails 110, 111 formed substantially at the proximal end of the chassis 100 and adapted to receive the slide (not pictured) when it is installed on the handgun. In an embodiment, chassis 100 does not include any slide rails at the front of the chassis, only the rear slide rails 110, 111. Barrel locking block 101 may include a pair of front slide rails 117, 118 (see, e.g., FIGS. 1, 16). In an embodiment wherein locking block 101 is integral with chassis 100, the front side rails 117, 118 may be formed integrally with the block-chassis combination as well. In still another embodiment, barrel locking block 101 is a separate component from chassis 100 (i.e., is not integral with chassis 100), and front side rails 117, 118 are formed on the distal end of chassis 100 rather than on the removable barrel locking block 101. In yet another embodiment, chassis 100 may not include any front or rear slide rails.

In an embodiment, chassis 100 further includes a pair of substantially parallel slide release notches 112, 113 formed in the side walls of the chassis 100. Inclusion of these slide release notches 112, 113 enables ambidextrous release of the slide from the weapon for purposes of disassembling the weapon, giving the weapon a greater range of use as between lefthanded and righthanded users.

In an embodiment, chassis 100 further includes channel 114 located at the distal end of the chassis 100, which is partially exposed forward of the locking block 101 when the locking block 101 is installed (or if the locking block 101 is integral with the chassis 100). The channel 114 is configured to partially receive the upper (not shown) when the handgun is assembled, and the channel 114 is of substantially the same dimensions as channel 209 located at the distal end of the frame 200 (see, e.g., FIGS. 7-8). The receiving chamber 219 in the frame 200 within which chassis 100 is partially received when chassis 100 is assembled with frame 200 is partially recessed from channel 209, as shown in FIG. 8. In this manner, channel 114 of the chassis 100 and channel 209 of the frame 200 form a substantially continuous channel within which the upper is partially received when the upper is installed. The upper is thus partially received by the chassis 100 and partially received by the frame 200 when the handgun is assembled.

Chassis 100 may be fabricated of a metallic material, such as aluminum or steel or alloys thereof. Chassis 100 may be cast, forged, 3D printed, formed by metal injection molding, or machined (such as CNC machining) or milled from a single billet. Alternatively, chassis 100 may be formed from any other material or using any other process which will yield a product capable of performing satisfactorily in a modular handgun system.

With reference to FIGS. 7-15, further features of an embodiment modular frame 200 are disclosed. The modular frame 200 further includes a trigger guard 205 within which the trigger of the trigger assembly (not shown) is accessible when the trigger assembly is assembled with the disclosed system as already discussed. The modular frame 200 further includes a grip portion 206, that is, the portion of the frame 200 that is held by at least one of the user's hands when operating the assembled handgun. Grip portion 206 includes a magazine chamber (not shown). Different grips may be more appropriate for different situations. A user with smaller hands may require a smaller grip whereas a user with larger hands may require a larger grip. Further, shorter grips are better for certain applications, while taller grips are better for others. And some users may desire a visually or tactilely basic grip, while others may desire a visually or tactilely unique grip. By virtue of utilizing the modular chassis-and-frame system disclosed in various embodiments, a single modular chassis 100 (the serialized part) may be used with numerous different modular frames 200 and, hence, multiple different grip portions 206, increasing the flexibility and customizability of the disclosed handgun system. It is also easier to obtain the embodiment frames 200 since they are separate from the serialized chassis 100, and can therefore be sold as accessories, not subject to the rules and regulations serialized components are subject to.

With reference to FIGS. 7-15, the details of an embodiment optional accessory rail extension module 207 according to embodiments of the invention are disclosed. Accessory rail extension module 207 includes an accessory rail portion 216 that may be in the form of any known style of accessory rail, such as picatinny, and may be suitable for connecting any type of accessory, such as weapon lights or laser/light combinations. Accessory rail extension module 207 includes a channel 208 alignable with channel 209 of the frame 200, channels 208 and 209 adapted to partially receive the upper (not shown). The diameter of the channel 208 of the chassis can be sized to be compatible with a Gen 3 GLOCK® or clone upper by having a relatively smaller diameter to account for the relatively smaller diameter of the recoil spring diameter in the Gen 3 upper; or it may be sized to be compatible with a Gen 4/5 GLOCK® or clone upper by having a relatively larger diameter to account for the relatively larger diameter of the recoil spring diameter in the Gen 4/5 upper.

Accessory rail extension module 207 may further include one or more set screw holes 210 formed toward the proximal end of the module 207, on the top side of the side walls that form the channel 208. FIGS. 7-15 illustrate two set screw holes 210 that are substantially parallel, although other embodiments may implement more or fewer set screw holes. Each of the one or more set screw holes 210 is configured to receive an appropriately sized set screw 211 as shown in the cutaway view of FIG. 14. Accessory rail extension module 207 may be pre-assembled with a set screw 211 loosely fitted in each of set screw holes 210, or each set screw 211 may be provided separately. In another embodiment, just one of set screw holes 210 and one set screw 211 are implemented to join the accessory rail portion 216 and the frame 200. In another embodiment, there may be no set screw holes 210 formed on the top side walls of module 207, and no set screws 211.

In an embodiment frame 200 with which the embodiment accessory rail extension module 207 can be used, the frame 200 may further include one or more dowel pin holes 212, each configured to receive an appropriately sized dowel pin 213. Each of the one or more dowel pin holes 212 is formed in distal the end of the frame 200 such that it is alignable with a corresponding dowel pin hole 214 formed in the proximal end of the accessory rail extension module 207. Dowel pins 213 may be sized such that each dowel pin 213 is fully received within the combination of the corresponding dowel pin holes 212, 214 on the facing ends of the frame 200 and the accessory rail extension module 207 when the two are assembled together, such as shown in the cutaway view of FIGS. 14-15. Dowel pins 213 may each include a ridge 215 sized to at least partially receive the tip of the corresponding set screw 211 when set screw 211 is tightened, as shown in the cutaway view of FIG. 14. In this manner, accessory rail extension module 207 may be easily and securely, but removably, attached to the frame 200 when an accessory rail is desired or necessary.

In an alternative embodiment, set screw holes 210 may be instead formed toward the distal end of the frame 200, on the top side the of side walls that form channel 209, each such set screw hole 210 configured to receive an appropriately sized set screw 211, with the dowel pins 213 received in dowel pin holes 214 formed in the proximal end of the accessory rail extension module 207. Each ridge 214 of each dowel pin 214 at least partially receives the corresponding tip of the each set screw 211 in the set screw holes of 210 formed in the frame 200 when the two pieces are assembled. Other means for aligning and connecting the accessory rail extension module 207 to the frame 200 may also be used, such as dovetail connections, tongue-and-groove connections, roll pins, tab-and-slot connections, or other known connection methods.

By utilizing the disclosed accessory rail extension module, rather than including an accessory rail on the frame 200 itself or on the chassis 100, the same frame 200 and chassis 100 can be used with a wide variety of accessory rails, or with no accessory rail at all, depending on the user's needs, increasing the flexibility and customizability of the disclosed system. Further, different lengths of accessory rail extension modules 207 can be used such that the overall length of the frame 200 and the module 207 and be customized to be substantially the same length as any slide length, further increasing the flexibility and customizability of the disclosed system. The frame 200 and rail extension module 207 can also be selected to have a channel of an appropriate diameter for receiving the recoil spring portion of the upper (not shown) depending on whether the upper is a Gen 3 with a smaller diameter recoil spring, or a Gen 4/5 with a larger diameter recoil spring, without having to also change the chassis 100, further increasing the flexibility and customizability of the disclosed system.

In an alternative embodiment which does not include the accessory rail extension module 207, the frame 200 is selected to be of a length that corresponds to a particular slide length (e.g., standard, compact, or subcompact, or other slide lengths). The frame 200 may include an integral accessory rail formed toward or at its distal end, or it may include no integral accessory rail. In either case, the same chassis 100 may be used with the frame 200 regardless of the overall length of frame 200, as the upper is not fully received within the length of the chassis 100, but are instead partially received within the length of the frame 200 as well, as both components are configured to partially receive a portion of the upper rather than the upper being partially received by only one component. And because the chassis 100 in any event is substantially the same length as or shorter in length than the frame 200 (or combination of frame 200 and module 207)—and, in turn, substantially the same length as or shorter than any slide length that might be used—chassis 100 will not extend beyond the distal end of the slide in any combination of modular components, making the assembled handgun more aesthetically pleasing and easier to holster and unholster.

Modular frame 200 and, where included, accessory rail module 207 may be fabricated of a polymer material or a metallic material, and may be cast, forged, 3D printed, formed by metal injection molding or plastic injection molding, or machined (such as CNC machining) or milled from a single billet. Alternatively, modular frame and, where included, accessory rail module 207 may be formed from any other material or using any other process which will yield a product capable of performing satisfactorily in a modular handgun system. In an embodiment that includes modular frame 200 and accessory rail module 207, frame 200 and module 207 may each be fabricated from the same types material. In another embodiment that includes modular frame 200 and accessory rail module 207, frame 200 and module 207 may each be fabricated of different types of material.

Figure 20:
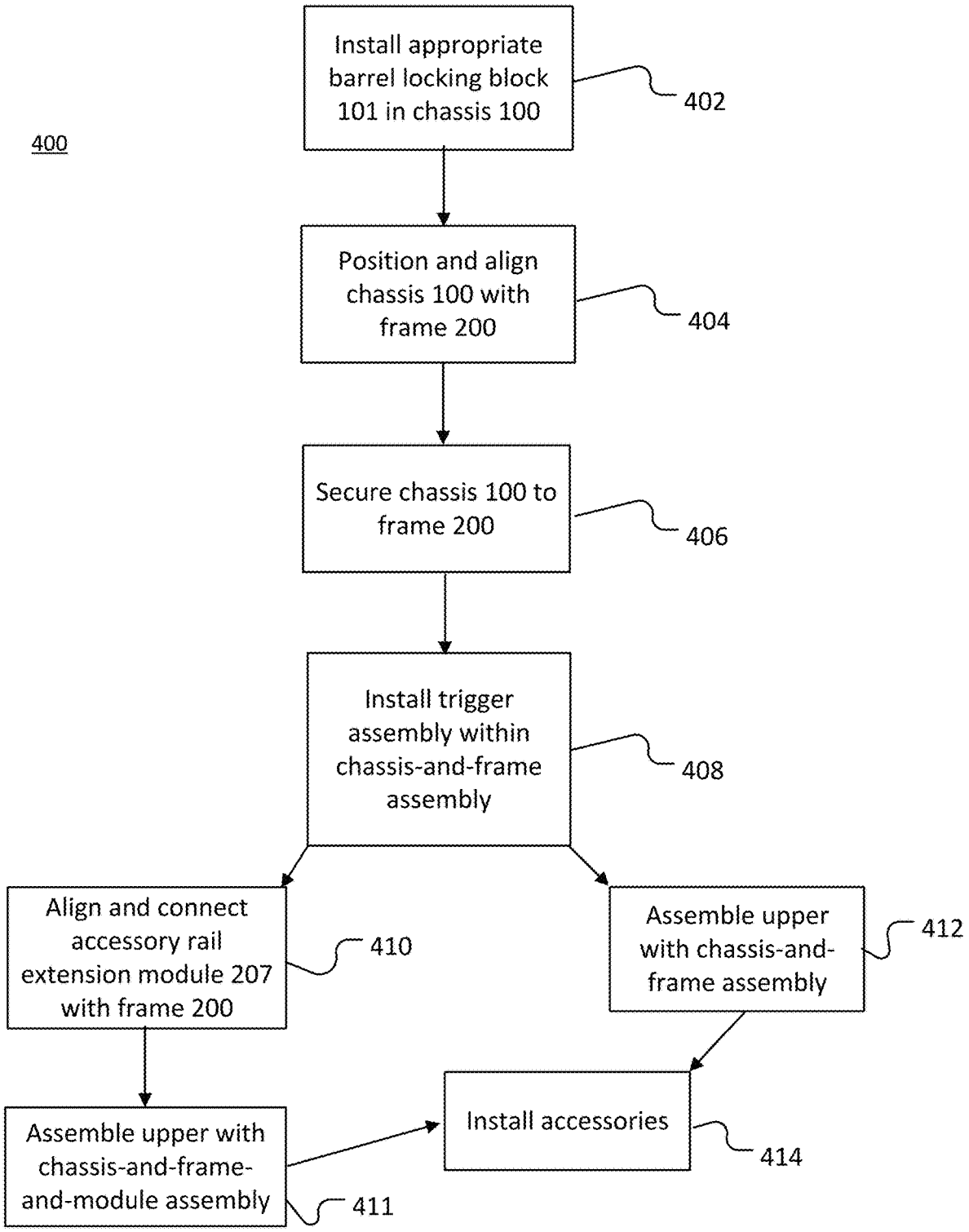
FIG. 20 is a flowchart of a method of assembling a modular handgun system according to embodiments of the invention.

Turning to FIG. 20, a method 400 of assembling a modular handgun that employs an embodiment modular frame and chassis is disclosed. Beginning with step 402, in an embodiment where chassis 100 does not include an integrated barrel locking block, separate barrel locking block 101 is positioned in chassis 100. In an embodiment where chassis 100 and barrel locking block 101 each include pairs of through holes 115, 116, barrel locking block 101 is positioned in chassis 100 such that the through holes 115, 116 are substantially aligned with each other. In an embodiment wherein barrel locking block 101 is integral with the chassis 100, step 402 is omitted. At step 404, chassis 100 is positioned within frame 200 and aligned within frame 200 using one or more of the disclosed alignment methods. In an embodiment, this is done without the need for any tools. Chassis 100 may be secured to frame 200 at step 406 via pin 218, slipped through aligning through holes 217, 115, 116 on the frame 200, chassis 101, and barrel locking block 101 respectively. Trigger assembly (not shown) is installed at step 408 by known means. In an embodiment that includes accessory rail extension module 207, module 207 is aligned with and connected to frame 200 at step 410 using one of the disclosed methods. The upper is assembled on the chassis-and-frame assembly by known means at steps 411, 412, depending on whether the assembly includes an accessory rail extension module 207. At step 412, the upper is assembled on the chassis-and-frame assembly with the barrel of the upper partially received in the substantially continuous channel formed by the channels 114, 209 in the chassis and frame, respectively, for embodiments without an accessory rail extension module 207. Or, in embodiments having the accessory rail extension module 207, the upper is assembled at step 411 with the barrel of the upper partially received in the substantially continuous channel formed by the channels 114, 209, and 208 in the chassis 100, frame 200, and module 207. In embodiments that include an accessory rail, either via the accessory rail extension module 207 or one formed as part of the frame 200, accessories may optionally be installed at step 414 as well, by known means.

Figure 21:
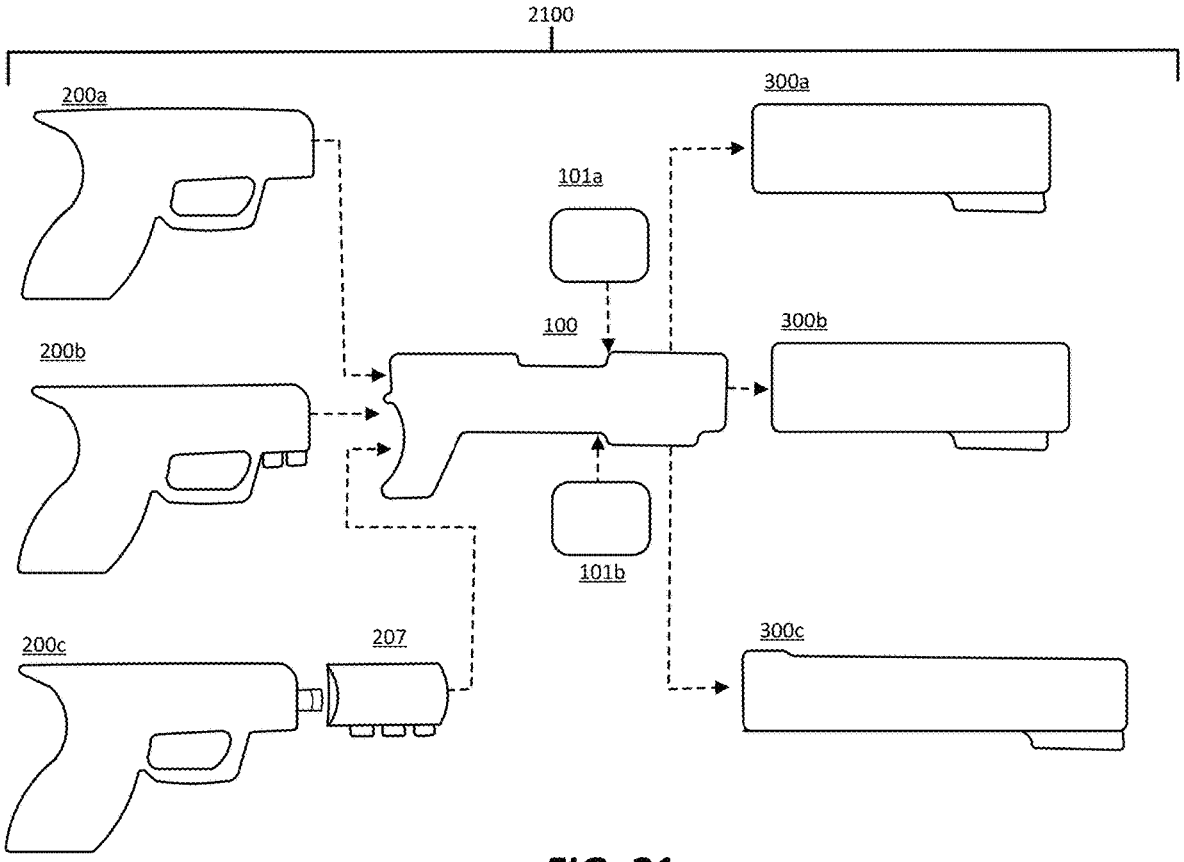
FIG. 21 is an embodiment modular handgun system according to embodiments of the invention.

Turning to FIG. 21, an embodiment modular handgun system 2100 is shown. The system includes an embodiment chassis 100, which may be used as a universal chassis suitable for use with multiple generations and calibers of GLOCK® or GLOCK® clone uppers. The system further includes one or more embodiment frames 200*a*-200*n*, wherein the one or more embodiment frames differ from each other with respect to at least one feature, such as appearance or style of grip, or overall length of the frame. The system may further include one or more embodiment accessory rail extension modules 207, which differ from each other with respect to at least one feature, such as type of rail or length of module. For example, in the embodiment system shown in FIG. 17, the system includes frame 200*a*, a standard-height, standard-length frame with no integrated accessory rail; frame 200*b*, a tall-height, standard-length frame with an integrated accessory rail; and frame 200*c*, a short-height, standard-length frame adapted to be connected to an embodiment accessory rail extension module 207 that will, combined, yield a frame-and-module assembly of long-length, the module 207 including a picatinny rail. Any other combination of frames 200 and/or modules 207 may be used. The system further includes one or more uppers 300*a*-300*n*, wherein the one or more uppers differ from each other with respect to at least one feature, such as size of slide (standard, compact, subcompact, long, competition, or other lengths), or caliber. For example, in the embodiment system shown in FIG. 17, the system includes upper 300*a*, a 9 mm, standard-length GLOCK® or GLOCK®-style upper; upper 300*b*, a .40 caliber, standard-length GLOCK® or GLOCK®-style upper; and upper 300*c*, a .45 caliber, long-length GLOCK® or GLOCK®-style upper. Any other combination of uppers may be used. The system may further include one or more different barrel locking blocks 101*a*-*n* as necessary or desirable for making different generation components usable with each other. For example, in the embodiment system shown in FIG. 17, the system includes barrel locking block 101*a* compatible with Gen 3 GLOCK® uppers where uppers 300*a* and 300*c* are Gen 3, so that any of frames 200*a*-200*c*, combined with chassis 100, can be used with uppers 300*a* and 300*c*; and a barrel locking block 101*b* compatible with Gen 4 GLOCK® uppers where upper 300*b* is Gen 4, so that any of frames 200*a*-200*c*, combined with chassis 100, can be used with upper 300*b*. Any other combination of generations (and barrel locking blocks) may be used. In this manner, in an embodiment, a user is provided with a multi-frame, multi-slide, single-chassis modular handgun system, increasing the flexibility and customizability of the overall handgun. In another embodiment, barrel locking block 101 is integral with chassis 100.

The previously described versions of the disclosed subject matter have many advantages that were either described or would be apparent to a person of ordinary skill familiar with the disclosure herein. Even so, all of these advantages or features are not required in all versions of the disclosed apparatus, systems, or methods. All features disclosed in the specification, and all the steps in any method or process disclosed, may be combined in any combination, except combinations where at least some of such features and/or steps are mutually exclusive. Each feature disclosed can be replaced by alternative features serving the same, equivalent, or similar purpose, unless expressly stated otherwise.

Additionally, this written description makes reference to particular features. It is to be understood that the disclosure in this specification includes all possible combinations of those particular features. For example, where a particular feature is disclosed in the context of a particular aspect or embodiment, that feature can also be used, to the extent possible, in the context of other aspects and embodiments.

Also, when reference is made in this specification to a method having two or more defined steps or operations, the defined steps or operations can be carried out in any order or simultaneously, unless context excludes those possibilities.

Further, the term "comprises" and its grammatical equivalents are used in this specification to mean that other components, features, steps, processes, operations, etc. are optionally present. For example, an article "comprising" or "which comprises" components A, B, and C can contain only components A, B, and C, or it can contain components A, B, and C along with one or more other components.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the embodiments.

What is claimed is:

1. A modular firearm system, comprising:

a frame having a grip configured to be held by a hand of a user and a receiving chamber formed within the grip;

a chassis having a receiving channel and one or more sidewalls extending from a bottom portion of the chassis, the one or more sidewalls structured to fit within and be received by the receiving chamber of the frame; and a barrel locking block structured to fit within and be received by the receiving channel of the chassis.

2. The modular firearm system of claim 1, in which the chassis and barrel locking block are structured to receive and secure an upper portion of the firearm to the frame.

3. The modular firearm system of claim 1, in which the chassis has a rearward extension structured to fit within a recess of the frame when the one or more sidewalls are received in the receiving chamber.

4. The modular firearm system of claim 1, further comprising an accessory rail extension.

5. The modular firearm system of claim 4, in which the accessory rail extension is attachable to the frame of the firearm by inserting one or more dowel pins of the frame into one or more receiving holes of the accessory rail extension.

6. The modular firearm system of claim 1, in which one or more apertures of the frame, one or more apertures of the chassis, and one or more apertures of the barrel locking block are aligned when the chassis is received in the receiving chamber of the frame and the barrel locking block is received in the receiving channel of the chassis.

7. The modular firearm system of claim 6, in which the frame, the chassis, and the barrel locking block are mechanically secured via a pin inserted through the one or more apertures of the frame, the one or more apertures of the chassis, and the one or more apertures of the barrel locking block.

8. The modular firearm system of claim 1, in which the barrel locking block has one or more alignment projections structured to fit within and be received by one or more alignment notches of the chassis and one or more alignment notches of the frame.

9. The modular firearm system of claim 1, in which the chassis has one or more slide rails positioned on a portion of the chassis nearest the grip.

10. A modular firearm system, comprising:

a frame having a grip configured to be held by hand of a user, a receiving chamber formed within the grip, and one or more frame apertures through an end of the frame opposite the grip;

a chassis having a receiving channel, one or more sidewalls extending from a bottom portion of the chassis and structured to fit within and be received by the receiving chamber of the frame, and one or more chassis apertures structured to align with the one or more frame apertures when the chassis is received in the receiving chamber; and a barrel locking block structured to fit within and be received by the receiving channel of the chassis, the barrel locking block having one or more block apertures structured to align with the one or more frame apertures and the one or more chassis apertures when the barrel locking block is received in the receiving channel; and wherein the frame, the chassis, and the barrel locking block are mechanically secured via a pin inserted through the one or more frame apertures, the one or more chassis apertures, and the one or more block apertures.

11. The modular firearm system of claim 10, in which the chassis and barrel locking block are structured to receive and secure an upper portion of the firearm to the frame.

12. The modular firearm system of claim 10, in which the chassis has a rearward extension structured to fit within a recess of the frame when the one or more sidewalls are received in the receiving chamber.

13. The modular firearm system of claim 10, further comprising an accessory rail extension.

14. The modular firearm system of claim 13, in which the accessory rail extension is attachable to the frame of the firearm by inserting one or more dowel pins of the frame into one or more receiving holes of the accessory rail extension.

15. The modular firearm system of claim 10, in which the barrel locking block has one or more alignment projections structured to fit within and be received by one or more alignment notches of the chassis and one or more alignment notches of the frame.

16. The modular firearm system of claim 10, in which the chassis has one or more slide rails positioned on a portion of the chassis nearest the grip.

17. A method of assembling a modular firearm, the method comprising the steps of:

installing a barrel locking block in a receiving channel of a chassis; and inserting sidewalls of the chassis into a receiving chamber of a frame, the sidewalls extending from a bottom portion of the chassis and the receiving chamber formed within a grip of the frame.

18. The method of claim 17, in which installing the barrel locking block comprises aligning projections of the barrel locking block in notches of the chassis.

19. The method of claim 17, further comprising the step of receiving an upper portion of the firearm in the chassis and the barrel locking block to secure the upper portion to the frame.

20. The method of claim 17, further comprising the step of installing a trigger assembly in the frame.

* * * * *